United States Patent [19]

Broser

[11] 4,111,094

[45] Sep. 5, 1978

[54] RHYTHM INSTRUMENT

[76] Inventor: Philip R. Broser, 6349 Emerald Lake Dr., Troy, Mich. 48084

[21] Appl. No.: 792,309

[22] Filed: Apr. 29, 1977

[51] Int. Cl.[2] ..... G10D 13/02; G10D 13/08

[52] U.S. Cl. ..... 84/402; 84/410; 84/411 R; 84/408

[58] Field of Search ..... D56/1 E, 1 R; 84/402, 84/403, 404, 408, 410, 411 R, 420, 421

[56] References Cited

U.S. PATENT DOCUMENTS

| | | | |
|---|---|---|---|
| D. 212,172 | 9/1968 | Lewis | D56/1 E |
| 716,025 | 12/1902 | Gammell | 84/402 |
| 1,323,132 | 11/1919 | Welch | 84/404 |
| 1,787,196 | 12/1930 | Haims | 84/408 X |
| 2,287,138 | 6/1942 | Sas | 84/410 |
| 2,516,725 | 7/1950 | Rowe | 84/403 |
| 2,577,497 | 12/1951 | Zuckerman | 84/403 |
| 3,705,527 | 12/1972 | Burnham | 84/403 |

*Primary Examiner*—Lawrence R. Franklin
*Attorney, Agent, or Firm*—Fisher, Gerhardt & Groh

[57] ABSTRACT

A musical instrument of the percussion type which includes a body member having walls converging from a relatively large open end so that the internal volume of the body member diminishes from one end of the instrument to the other. The instrument is played by striking its top surface with the hands or sticks and sound is amplified and emitted from the open end.

9 Claims, 5 Drawing Figures

RHYTHM INSTRUMENT

This invention relates to musical instruments and particularly to percussion instruments such as drums which are played by striking the instrument with the hands or a mallet.

Typically rhythm instruments of the percussion type such as drums are generally cylindrical with ends closed by vellum or the like. Differences in sound are usually provided by different types or sizes of drums. It would be highly desirable to have a rhythm instrument wherein the location on a single instrument which is struck by the player determines the frequency of the vibration.

Also it would be highly desirable to have a rhythm instrument in which the sound produced by striking it is naturally amplified.

It therefore is an object of the invention to provide a percussion instrument which is played by striking the playing surface in which the resultant sound is amplified in much the same manner as the sound from a megaphone.

Another object of the invention is to provide a rhythm instrument in which the vibration frequency varies from one end of the instrument to the other.

A rhythm instrument is provided in which the instrument includes an elongated body member having converging walls extending from a large end toward a small end portion and in which the large end portion is open to the interior of the instrument so that sounds produced by striking the instrument are naturally amplified and transmitted through the large open end. The tapered top playing surface produces different sounds depending on the location longitudinally of the instrument which is struck by the fingers or a stick.

Figure 1:
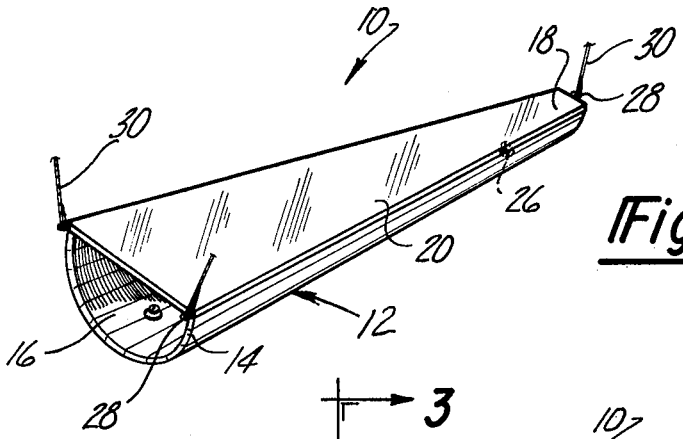
FIG. 1 is a perspective view of one embodiment of the invention.

A rhythm instrument embodying the invention is designated generally at 10 and includes a body member 12 which is generally elongated and has side walls 14 which converge relative to each other from a relatively large open end indicated at 16 toward a small end portion 18. The upper surface of the body member 12 is provided with a playing surface 20 which may be made of thin wood, plastic or metal but preferably is made of a drum head material such as skin or vellum and is stretched tightly between the converging side walls 14. The membrane 20 is adapted to be struck with fingers, mallets or drum sticks to produce a sound which is transmitted through the relatively large open end 16. The side walls 14 may be made of tapered wood strips arranged in a generally semicircular form so that the body member 12 forms one half of an elongated, truncated cone.

The small end portion 18 of the body member 12 may be left open or may be provided with a separate wall member to close the small end. Also, if desired, a pair of microphones 24 may be disposed within the body member and spaced longitudially thereof with one of the microphones 24 amplifying the lower frequency vibrations at the larger end of the rhythm instrument and the other microphone amplifying the higher frequencies at the smaller end of the rhythm instrument.

The body member may be provided with eyes 28, two of which are located at the large open end 16 and one of which is located at the smaller end of the body member 12. The eyes 28 receive suspension members 30 by which the body member may be suspended from a frame work such as that designated at 32 in FIG. 4. The suspension members 30 prevent dampening of the vibration produced when the playing surface formed by the membrane 20 is struck to produce a sound.

Figure 4:
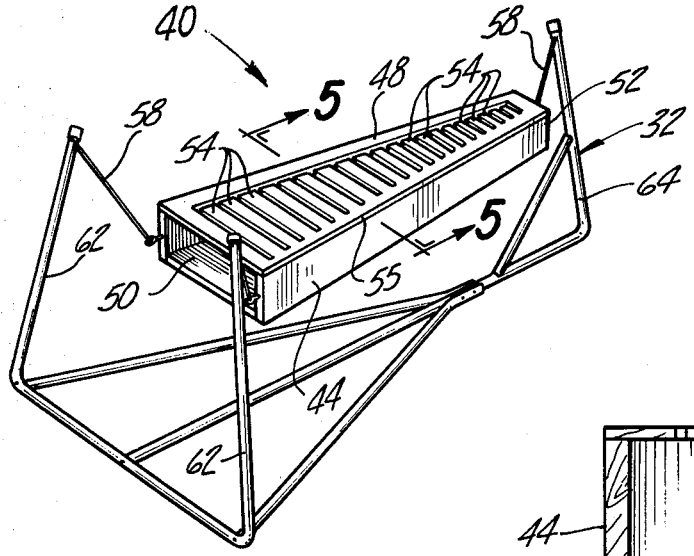
FIG. 4 is a perspective view of another embodiment of the invention.
Figure 5:
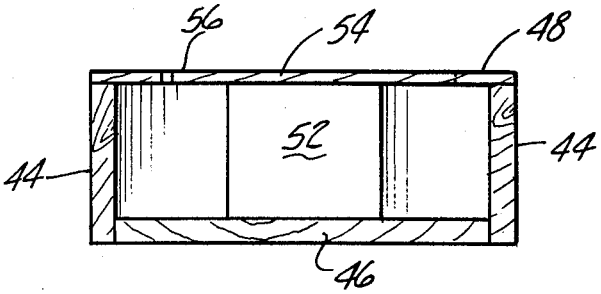
FIG. 5 is a cross sectional view of the instrument seen in FIG. 4 taken generally on line 5—5 in FIG. 4.

Referring now to FIGS. 4 and 5, another embodiment of the invention is disclosed in which a rhythm instrument is designated generally at 40. The instrument 40 has a body member which has converging side walls 44. The side walls 44 are spaced apart by a bottom wall 46 and a top playing surface 48. The bottom wall 46 and 48 are illustrated as being generally parallel to each other but if desired the bottom and top surfaces also may be made to converge towards each other from the relatively large open end 50 to the small end 52.

In actual practice the body member can be made of wood. Also the top playing surface 48 may be made of wood in which case it is desirable that the grain of the wood extend transversely of the top 48. The top 48 is provided with a plurality of fingers 54 integral with one edge 55 of the top playing surface 48 and cantilevered so that the free ends are free to vibrate when the fingers 54 are struck with a drum stick or mallet. The fingers 54 adjacent the large open end 50 is relatively long and each finger becomes progressively shorter as the small end 52 of the body member 42 is approached.

The body member may be suspended by way of flexible members 58 to the frame 32 so that during play vibrations are not unduly dampened. The frame 32 may be of any general form but preferably includes a pair of generally vertical posts 62 adjacent to the open end 50 of the body member 42 and a generally vertically extending post 64 adjacent the small end of the body member.

Figure 2:
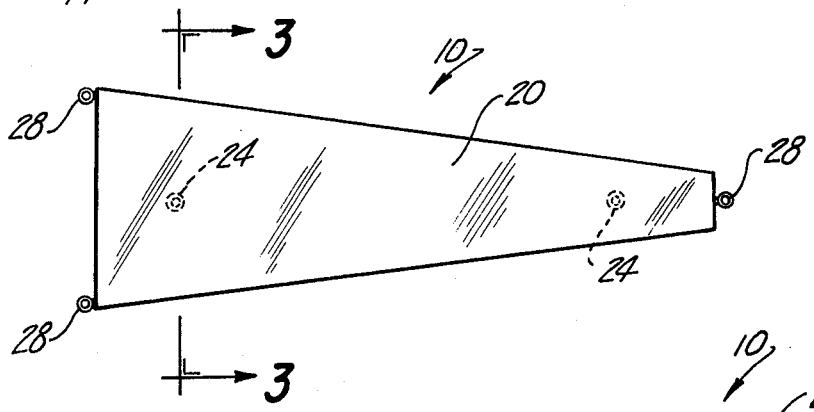
FIG. 2 is a top view of the playing surface of the rhythm instrument seen in FIG. 1.
Figure 3:
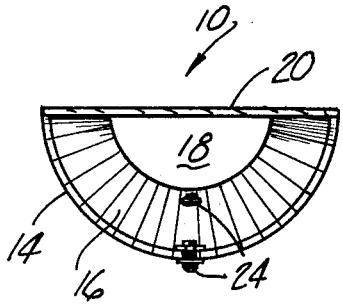
FIG. 3 is a cross sectional view taken generally on line 3—3 in FIG. 2.

If desired the body member of the instrument 40 may be provided with a pair of microphones disposed similarly to the microphones 24 shown in FIGS. 1 and 2 for the purpose of amplifying the vibrations produced at opposite ends of the rhythm instrument 10. The tapered or converging configuration of the body members of both of the instruments 10 and 40 may be of various dimensions. In actual practice it was found that a desirable sound was produced with an instrument in which the top playing surface had edges converging toward each other to include an angle of approximately 26° and in which the instrument was approximately 46 inches long.

It will be noted that the body member of instrument 10 could be provided with a top playing surface 48 such as seen in FIG. 4 instead of the flexible top playing surface 20. Similarly the instrument 40 could be provided with a skin top 20 as seen in FIG. 1 instead of the playing surface 48. The body members of both embodiments of the invention are such that the volume diminishes uniformly from the large open end 16 or 50 to the small end. Also, if desired, the body members of the instruments 10 and 40 can be so constructed that the walls converge to a point at the small end.

A rhythm instrument is provided in which a body member has converging walls extending from a large open end towards a smaller end which may be either open or closed. The large open end acts to emit sounds which are produced when the top playing surface is struck and the converging walls serve to naturally amplify the sounds which are produced. If desired, however, microphones may be used to amplify the vibration produced in the area adjacent opposite ends of the instrument.

I claim:

1. A rhythm instrument comprising; a body member comprising an elongated structure having walls converging from one end to the other of said body member, said body member forming a large end portion and a small end portion, said large end portion being open to the interior of said body member, a flat playing surface formed at the top of said body member and adapted to be struck to produce a sound.

2. The combination of claim 1 in which said flat top surface portion is made of a material capable of vibrating.

3. The combination of claim 1 in which said flat top head surface is made of a flexible membrane.

4. The combination of claim 1 in which said flat top surface includes a plurality of adjacent fingers, one end of each of said fingers being formed integrally with said body member and having the opposite end free to permit vibration.

5. The combination of claim 4 in which each of said fingers is progressively shorter from said large end toward said small end portion.

6. The combination of claim 1 in which said body member forms one half of a truncated cone.

7. The combination of claim 1 and further including a pair of microphones spaced longitudially of said body member.

8. The combination of claim 1 wherein said body member is suspended by flexible members.

9. The combination of claim 1 wherein the volume within said body member diminishes uniformly from said large end portion toward the small end portion.

* * * * *